US010262589B2

(12) United States Patent
Cheng

(10) Patent No.: US 10,262,589 B2
(45) Date of Patent: Apr. 16, 2019

(54) PIXEL COMPENSATION CIRCUIT

(71) Applicant: INT TECH CO., LTD., Hsinchu County (TW)

(72) Inventor: Shih-Song Cheng, Kaohsiung (TW)

(73) Assignee: INT TECH CO., LTD., Hsinchu County (TW)

( * ) Notice: Subject to any disclaimer, the term of this patent is extended or adjusted under 35 U.S.C. 154(b) by 0 days.

(21) Appl. No.: 15/702,016

(22) Filed: Sep. 12, 2017

(65) Prior Publication Data

US 2018/0108296 A1 Apr. 19, 2018

(30) Foreign Application Priority Data

Oct. 19, 2016 (TW) ..... 105133704

(51) Int. Cl.
*G09G 3/3233* (2016.01)

(52) U.S. Cl.
CPC ... *G09G 3/3233* (2013.01); *G09G 2300/0404* (2013.01); *G09G 2300/0426* (2013.01); *G09G 2300/0439* (2013.01); *G09G 2300/0819* (2013.01); *G09G 2300/0842* (2013.01); *G09G 2300/0861* (2013.01); *G09G 2310/0262* (2013.01); *G09G 2310/08* (2013.01); *G09G 2320/0233* (2013.01); *G09G 2320/045* (2013.01)

(58) Field of Classification Search
CPC ..... G09G 3/3233; G09G 2300/0404; G09G 2300/0426; G09G 2300/0439; G09G 2300/0819; G09G 2310/08; G09G 2320/0233; G09G 2320/043; G09G 2320/045
See application file for complete search history.

(56) References Cited

U.S. PATENT DOCUMENTS

| | | | | |
|---|---|---|---|---|
| 8,692,821 | B2 * | 4/2014 | Park | G09G 3/3233 345/211 |
| 9,129,555 | B2 * | 9/2015 | Lee | G09G 3/32 |
| 9,990,883 | B2 * | 6/2018 | Park | G09G 3/3233 |
| 2009/0121981 | A1 * | 5/2009 | Yoo | G09G 3/3233 345/76 |
| 2011/0043544 | A1 * | 2/2011 | Nakamura | G09G 3/3233 345/690 |
| 2011/0134100 | A1 * | 6/2011 | Chung | G09G 3/325 345/212 |
| 2011/0157126 | A1 * | 6/2011 | Chung | G09G 3/3233 345/211 |

(Continued)

*Primary Examiner* — Tom V Sheng
(74) *Attorney, Agent, or Firm* — WPAT, P.C., Intellectual Property Attorneys; Anthony King

(57) ABSTRACT

A pixel compensation circuit is arranged for compensating the critical parameter associated with the electrical properties of the components in thin film transistors of an active matrix organic light emitting diode display or similar illumination systems to avoid uneven brightness resulted from the voltage drop effect. The pixel compensation circuit is defined in a sub-pixel area, wherein there are eight thin film transistors and one capacitor, and the circuit is operated by two control signals. In contrast, three control signals are required in the conventional technologies. The fewer control signals are required, which is benefit to the flexibility of the layout and design of specification.

20 Claims, 7 Drawing Sheets

(56) References Cited

U.S. PATENT DOCUMENTS

| | | | | |
|---|---|---|---|---|
| 2015/0138253 | A1* | 5/2015 | Kimura | G09G 3/3266<br>345/690 |
| 2015/0356924 | A1* | 12/2015 | Chen | G09G 3/3233<br>345/690 |
| 2016/0148569 | A1* | 5/2016 | Park | G09G 3/3233<br>345/212 |
| 2016/0210892 | A1* | 7/2016 | Ohara | G09G 3/3258 |
| 2017/0092193 | A1* | 3/2017 | Na | G09G 3/3233 |
| 2017/0124941 | A1* | 5/2017 | Na | G09G 3/2092 |
| 2017/0301289 | A1* | 10/2017 | Jeong | G09G 3/3233 |
| 2018/0005573 | A1* | 1/2018 | Kim | G09G 3/3275 |

* cited by examiner

PIXEL COMPENSATION CIRCUIT

BACKGROUND

Currently, an active matrix organic light emitting diode (AMOLED) display is the focus of the display field due to its amazing image quality and optical specification better than the conventional display.

The AMOLED display is used as an emitter with current through an organic light emitting diode, the current is controlled by an active matrix, and brightness of gray scale is determined by an amount of the current during light emission.

The active matrix is composed of a group of pixel units, and an effective area of light emission is defined by resolution. The effective area of light emission is an area of pixel units multiplied by a resolution in a vertical direction and then multiplied by a resolution in a horizontal direction.

A typical pixel unit is composed of three sub-pixel units. Generally, a sub-pixel unit is composed of a plurality of thin film transistors and capacitors, a gray scale of emission brightness of a sub-pixel area is controlled by the thin film transistor, and the capacitor is used as a storage potential to stabilize driving current.

However, in comparison with other displays (for example, liquid crystal displays), since the active matrix organic light emitting diode display has a characteristic of current driving light emission, the brightness difference of the gray scale can be directly affected by component electrical properties of the thin film transistor. When the thin film transistors in different sub-pixels have too much difference in component electrical properties, an uneven image property would be formed. For example, mura phenomenon occurs.

Therefore, to overcome the above problem, a pixel compensation circuit is formed to compensate parameters (threshold voltage Vth, for example) of electrical properties of critical components, so as to repair the deterioration of the image quality due to the difference between characteristics of the components.

In addition, another major problem occurring in the current driving system is the voltage drop (IR-drop) effect, which is generated when the distal voltage drop is caused by the electrical load of the system. The large output current corresponds to large electrical load, such that for an active matrix organic light emitting diode (AMOLED) display which is typically designed as a common power source, the brightness near the power source end is higher than the brightness away from the power source end. The issue of brightness uniformity can be overcome by a compensation circuit.

However, as the progressiveness of display technologies, there are more and more pixels in one unit size, a component size for displaying each pixel is correspondingly reduced. At least three signals are required in the conventional pixel compensation circuit, such that at least three signal generators or wirings are required, so as to limit the size reduction.

Accordingly, the conventional technologies have many drawbacks and need to be improved. Therefore, the present invention provides a pixel compensation circuit to improve brightness of an AMOLED and reduce the number of the required control signals.

BRIEF SUMMARY OF THE INVENTION

The present invention relates to a pixel compensation circuit, and particularly, to a pixel compensation circuit for improving brightness uniformity of an active-matrix organic light emitting diode (AMOLED).

An aspect of the present invention provides a pixel compensation circuit. According to one embodiment of the present invention, the pixel compensation circuit includes an input module, a reset module, a data processing module and a switch module. The input module receives a reference level and a data signal, and generates a first signal in response to a light emission control signal and a scan signal. The reset module receives the reference level and generates a reset signal in response to a sub-light emission control signal and the scan signal. The data processing module receives the first signal, the reset signal and a first voltage, and generates a second signal in response to the scan signal. The switch module receives the second signal and generates a light emission signal in response to the light emission control signal.

The input module includes a first transistor, a seventh transistor and a storage capacitor. The first transistor includes a first source terminal applied with the data signal, a first gate terminal applied with the scan signal, and a first drain terminal connected to a second node. The seventh transistor includes a seventh source terminal applied with the reference level, a seventh gate terminal applied with the light emission control signal and a seventh drain terminal connected to the second node. The storage capacitor includes a first electrode and a second electrode, the first electrode is connected to the second node, and the second electrode is connected to the data processing module.

Further, the data processing module includes a sixth transistor, a third transistor and a second transistor. The sixth transistor includes a sixth source terminal applied with the first voltage, a sixth gate terminal connected to the input module and a sixth drain terminal connected to the switch module. The third transistor includes a third source terminal connected to the sixth drain terminal, a third gate terminal applied with the scan signal, and a third drain terminal connected to a third node. The second transistor includes a second source terminal connected to the third node, a second gate terminal applied with the scan signal, and a second drain terminal connected to the sixth gate terminal.

In addition, the reset module includes a fifth transistor and a fourth transistor. The fifth transistor includes a fifth source terminal applied with the reference level, and a fifth gate terminal applied with a sub-light emission control signal. The fourth transistor includes a fourth source terminal connected to a fifth drain terminal of the fifth transistor, a fourth gate terminal applied with the scan signal, and a fourth drain terminal connected to the third node.

In the practical applications, when a plurality of pixel compensation circuits are connected in series to form a set of pixel compensation circuits, the light emission control signal of an (N+1)th level pixel compensation circuit is used as the sub-light emission control signal of an Nth level pixel compensation circuit, and N is a positive integer.

The pixel compensation circuit further includes a light emitting component for receiving the light emission signal and then emitting light.

In comparison with the conventional technologies, the pixel compensation circuit of the present invention can be used for compensating the critical parameter, such as a threshold voltage $V_{th}$, associated with the electrical properties of the components in thin film transistors of an active matrix organic light emitting diode display or similar illumination systems, so as to improve the image quality and avoid uneven brightness resulted from the voltage drop (IR-drop) effect. The pixel compensation circuit of the present invention is defined in a sub-pixel area, wherein there are eight thin film transistors and one capacitor, and the circuit is operated by two control signals. In contrast, three control signals are required in the conventional technologies. The fewer control signals are required in the present invention, which is benefit to the flexibility of the layout and design of specification.

Advantages and spirit of the present disclosure are best understood from the following detailed description when read with the accompanying figures.

BRIEF DESCRIPTION OF THE DRAWINGS

Aspects of the present disclosure are best understood from the following detailed description when read with the accompanying figures. It is noted that, in accordance with the standard practice in the industry, various features are not drawn to scale. In fact, the dimensions of the various features may be arbitrarily increased or reduced for clarity of discussion.

DETAILED DESCRIPTION

The present invention is described in detail with reference to the accompanying drawings that clearly illustrate objectives, technical solution and advantages of the present invention.

Figure 1:
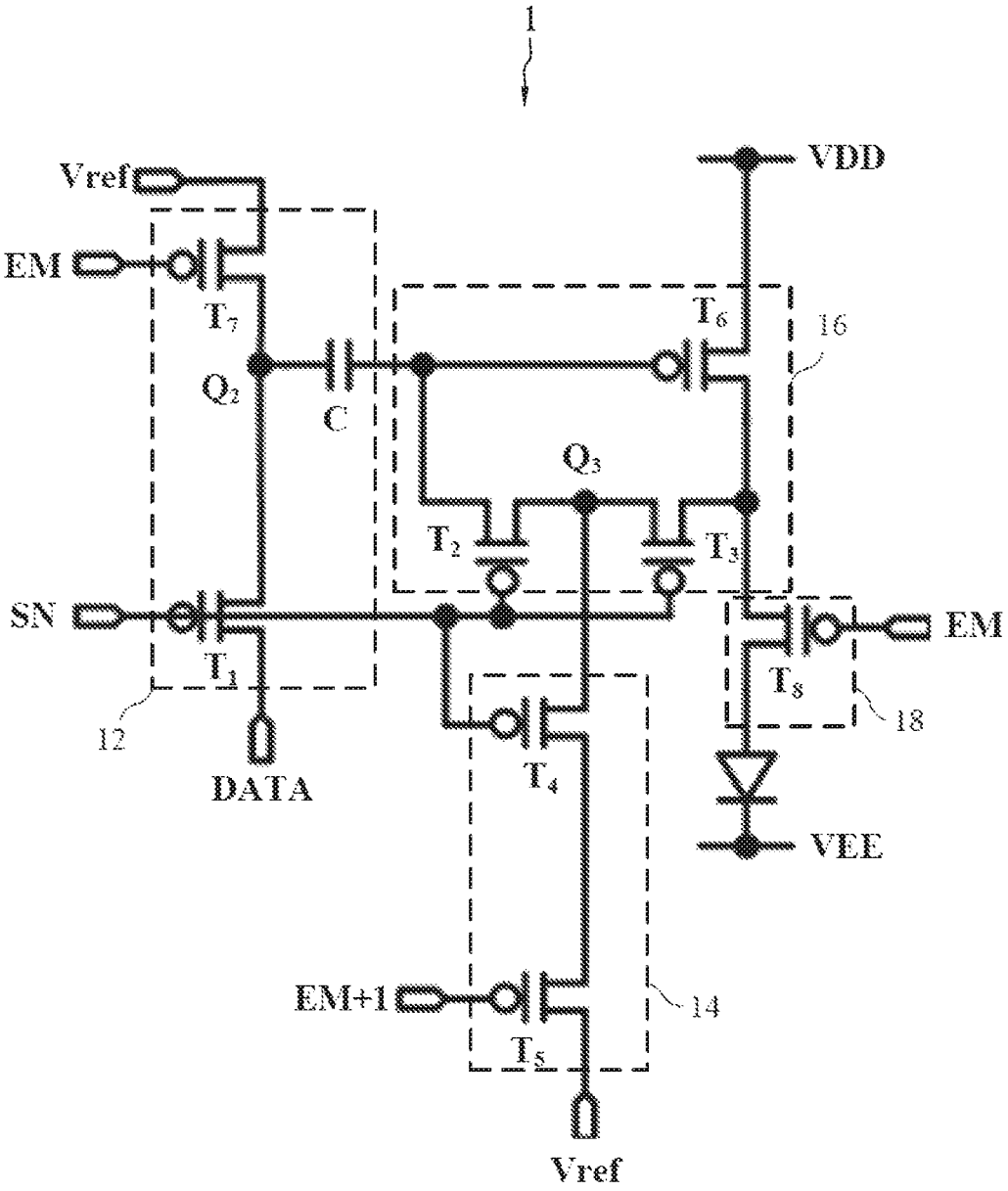
FIG. 1 is a schematic view showing a pixel compensation circuit in accordance with an embodiment of the present invention.

Please refer to FIG. 1, which is a schematic view showing a pixel compensation circuit according to an embodiment of the present invention. One aspect of the present invention provides a pixel compensation circuit 1. According to one embodiment of the present invention, the pixel compensation circuit 1 includes an input module 12, a reset module 14, a data processing module 16 and a switch module 18. The input module 12 receives a reference level Vref and a data signal DATA, and responds to a light emission control signal EM and a scan signal SN, so as to produce a first signal. The reset module 14 receives the reference level Vref and responds to a sub-light emission control signal EM+1 and the scan signal SN, so as to produce a reset signal. The data processing module 16 receives the first signal, the reset signal and a first voltage VDD, and responds to the scan signal SN, so as to produce a second signal. The switch module 18 receives the second signal, and responds to the light emission control signal EM, so as to produce a light emission signal EM.

The sub-light emission control signal EM+1 is the light emission control signal EM with one line time shift.

The input module 12 includes a first transistor $T_1$, a seventh transistor $T_7$ and a storage capacitor C. The first transistor T1 has a first source terminal applied with a data signal DATA, a first gate terminal applied with a scan signal SN, and a first drain terminal connected to a second node $Q_2$. The seventh transistor $T_7$ includes a seventh source terminal applied with a reference level Vref, a seventh gate terminal applied with a light emission control signal EM, and a seventh drain terminal connected to the second node $Q_2$. The storage capacitor C has a first electrode and a second electrode, the first electrode is connected to the second node $Q_2$, and the second electrode is connected to the data processing module 16.

The data processing module 16 includes a sixth transistor $T_6$, a third transistor $T_3$ and a second transistor $T_2$. The sixth transistor $T_6$ has a sixth source terminal applied with a first voltage VDD, a sixth gate terminal connected to the input module 12, and a sixth drain terminal connected to the switch module 18. The third transistor $T_3$ has a third source terminal connected to the sixth drain terminal, a third gate terminal applied with a scan signal SN, and a third drain terminal connected to a third node $Q_3$. The second transistor $T_2$ has a second source terminal connected to the third node $Q_3$, a second gate terminal applied with a scan signal SN, and a second drain terminal connected to the sixed gate terminal.

The reset module 14 includes a fifth transistor $T_5$ and a fourth transistor $T_4$. The fifth transistor $T_5$ has a fifth source terminal applied with a reference level Vref, and a fifth gate terminal applied with a sub-light emission control signal EM+1. The fourth transistor $T_4$ has a fourth source terminal connected to a fifth drain terminal of the fifth transistor $T_5$, a fourth gate terminal applied with a scan signal SN, and a fourth drain terminal connected to a third node $Q_3$.

The switch module 18 includes an eighth transistor $T_8$, which has an eighth source terminal connected to the data processing module 16, an eighth gate terminal applied with a light emission control signal EM, and an eighth drain terminal for outputting a light emission signal.

The pixel compensation circuit 1 further includes a light emitting component for receiving the light emission signal and then emitting light.

In practical applications, the light emitting component includes a first pole and a second pole. The first pole is used for receiving the light emission signal, and the second pole is connected to a second voltage VEE having a level different from that of the first voltage VDD.

In addition, the light emitting component can be an active-matrix organic light emitting diode (AMOLED).

In practical applications, second voltage VEE can be obtained from being connected to the ground.

Figure 2:
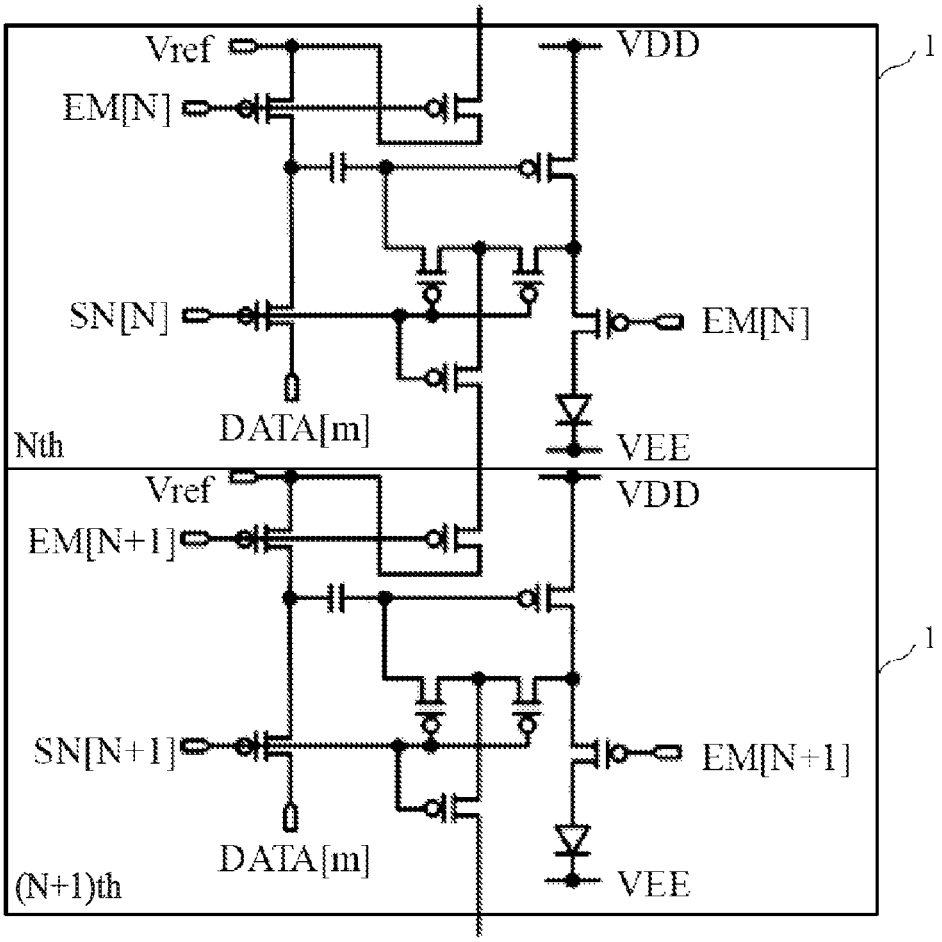
FIG. 2 is a schematic view showing pixel compensation circuits of the present invention connected in series to a set of pixel compensation circuits.

Please refer to FIG. 2, which is a schematic diagram showing the pixel compensation circuits 1 of the present invention connected in series to a set of pixel compensation circuits 1. In practical applications, when a plurality of pixel compensation circuits 1 are connected in series to form a set of pixel compensation circuits 1, a light emission control signal EM of an (N+1)th level pixel compensation circuit 1 can be used as a sub-light emission control signal EM+1 of an Nth level pixel compensation circuit 1, in which N is a positive integer.

Since the Nth level compensation circuit 1 can be used as the sub-light emission control signal EM+1 by being connected to the next-level light emission control signal EM+1, thereby reducing a needed signal generator and space occupied by wirings of the signal generator. Accordingly, in comparison with the typical pixel compensation circuit in which three control signals are required, the pixel compensation circuit 1 of the present invention only requires two control signals which is benefit to optimization of the layout.

Figure 3:
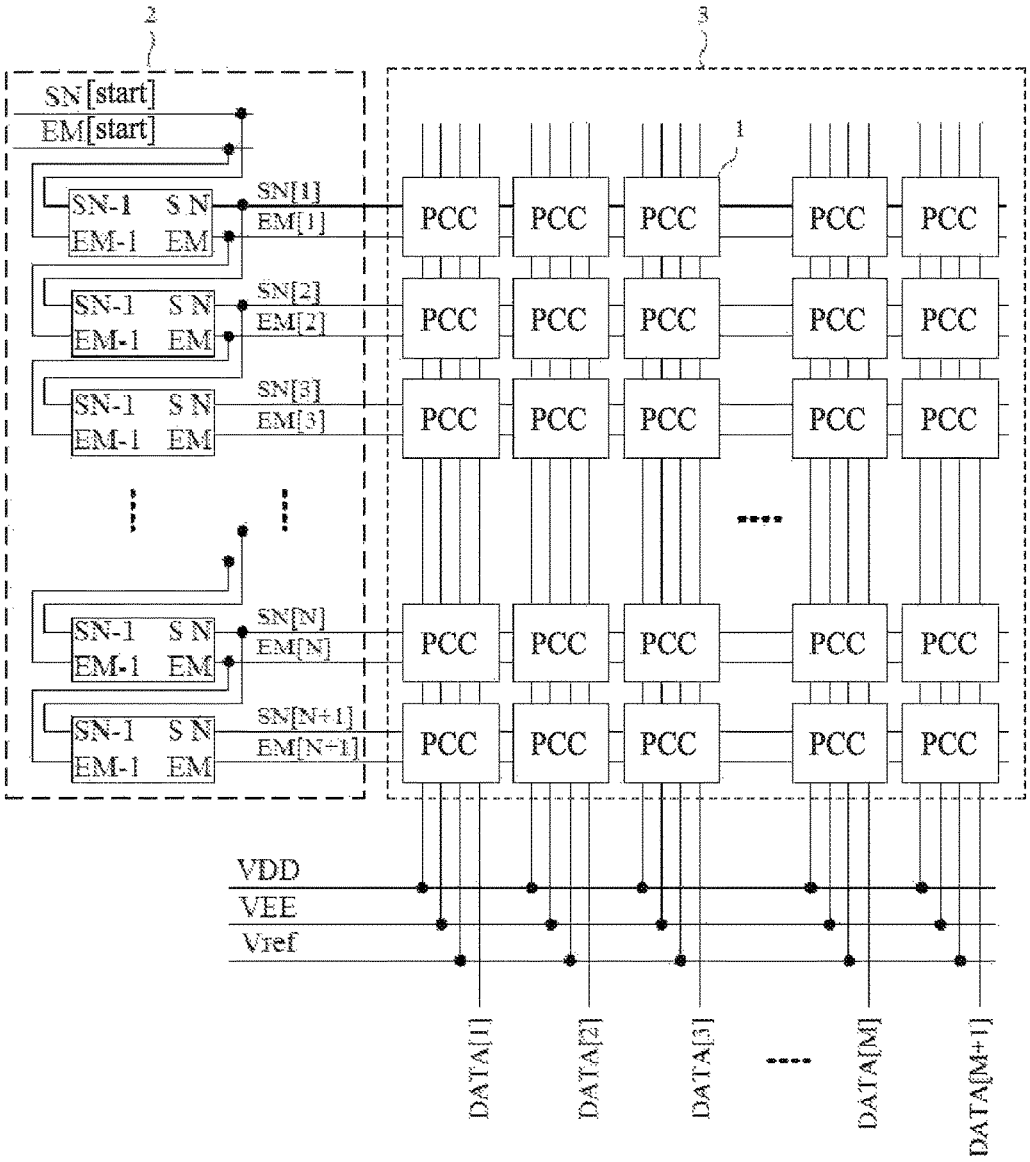
FIG. 3 is a schematic view showing a display system using a pixel compensation circuit of the present invention.

Please refer to FIG. 3, which is a schematic view showing a display system using the pixel compensation circuit (PCC) 1 of the present invention. In one embodiment, a display system with [N+1]*[M+1] resolution can be divided into two areas, a gate driver on array (GOA) circuit area 2 and a display pixel circuit area 3, wherein the display pixel circuit area 3 is composed of a plurality of pixel compensation circuits 1 connected in series. A double of line time is used as a unit of time shift for the GOA circuit area 2 to scan delivery, and the GOA circuit 2 can be replaced by an integrated circuit IC with the same function. Each sub-pixel circuit in the display pixel circuit area 3 is the pixel compensation circuit 1 of the present invention, and is controlled and driven by the GOA circuit area 2. The operation is activated in a GOA scan direction and in a sequence of SN[1]→SN[2] . . . ' EM[1]→EM[2] . . . . In FIG. 3, each pixel compensation circuit 1 only requires two control signals, and the wirings of the first voltage VDD, the second voltage VEE and the reference level Vref can be wound in a horizontal or vertical direction depending on space and manner of layout arrangements, thereby increasing flexibility of layout arrangements.

Figure 4:
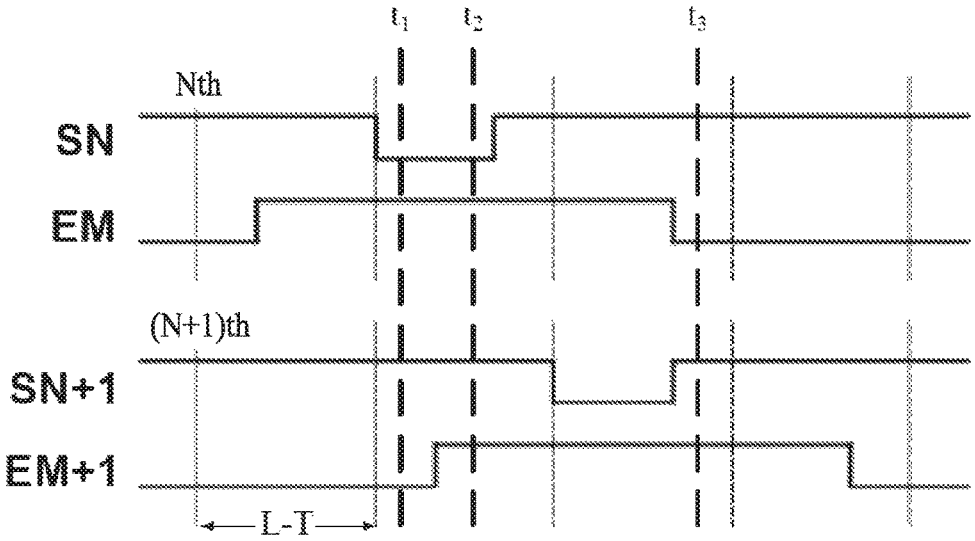
FIG. 4 is a sequence diagram showing an operation of a pixel compensation circuit in accordance with an embodiment of the present invention.

Please refer to FIG. 4, which is a sequence diagram showing an operation of the pixel compensation circuit 1 in accordance with an embodiment of the present invention. The operation sequence diagram of the compensation circuit 1 of the present invention is shown in FIG. 4, wherein please note that only the Nth level and the (N+1)th level light emission control signals EM, EM+2 and the scan signal SN, SN+1 are shown, and the light emission control signals EM, EM+1 and the scan signals SN, SN+2 respectively shift for one line time (L−T). For example, in the Nth level pixel compensation circuit 1, there are three stages while the pixel compensation circuit 1 works: a reset stage (a first timing $t_1$) a compensation stage (a second timing $t_2$) and a write light emission stage (a third timing $t_3$), which are described in detail in the following descriptions. In the following figures, a first node $Q_1$ is added to facilitate the descriptions, wherein the first node $Q_1$ is an electrical connection junction of the storage capacitor C, the second transistor $T_2$ and the sixth transistor $T_6$.

Figure 5:
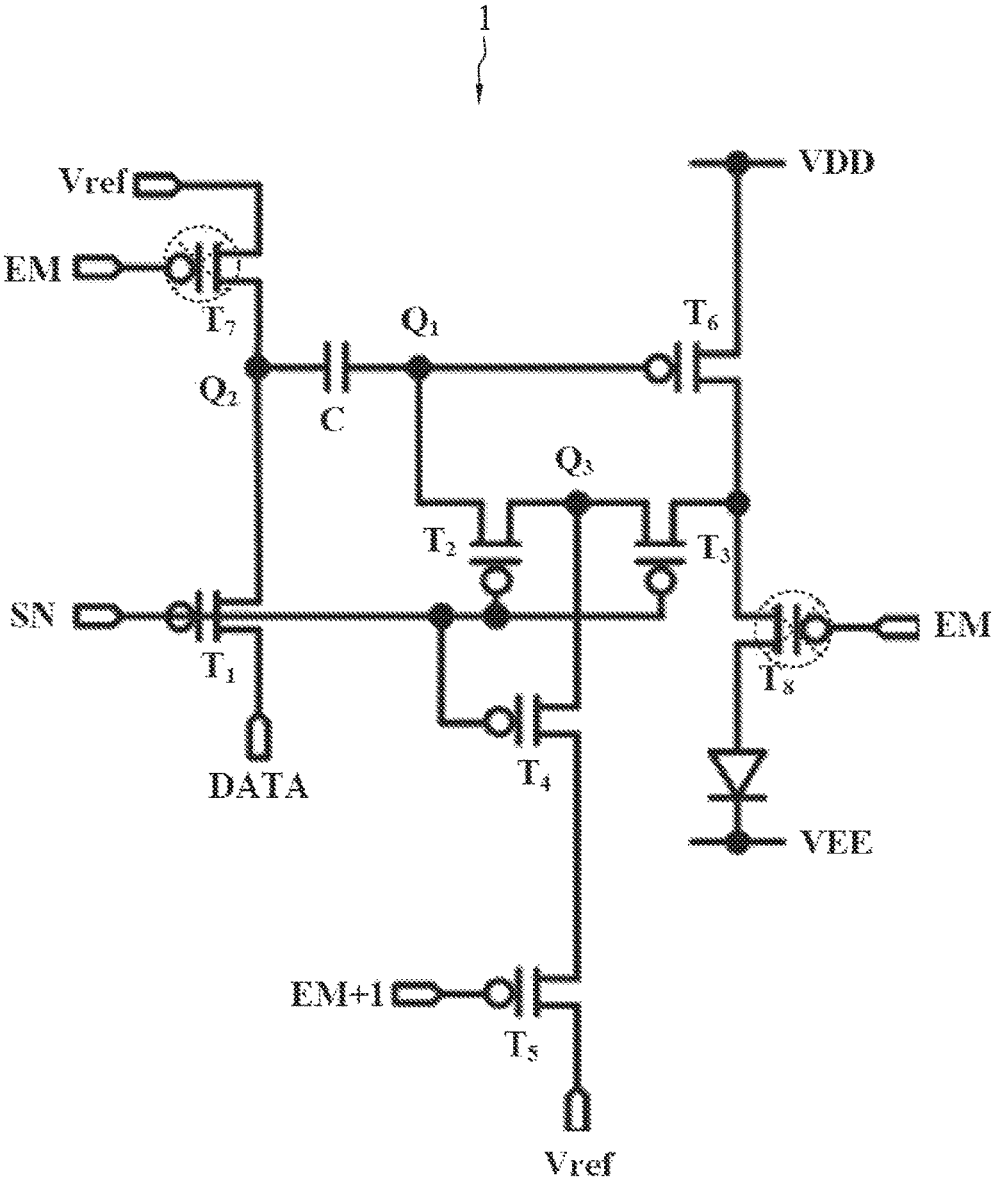
FIG. 5 is a schematic diagram showing an operation of the pixel compensation circuit of FIG. 4 at a first timing.

Please refer to FIG. 4 and FIG. 5. FIG. 5 is a schematic diagram showing an operation of the pixel compensation circuit of FIG. 4 at the first timing $t_1$. In the reset stage, due to the light emission control signal EM, the seventh transistor $T_7$ and the eighth transistor $T_8$ are turned off, and the remaining transistors are conducted. At this time, the signal of the first note $Q_1$ is the reference level Vref, the signal of the second node $Q_2$ is the data signal DATA, and the signal of the third node $Q_3$ is the reference level Vref.

At the same time, the gate potential $V_g$ of the sixth transistor T6 for driving is supplied by the first note $Q_1$ (Vref), the source potential $V_s$ is supplied by the first voltage VDD, and $V_{sg}$=VDD−Vref>$V_{th}$ is satisfied, wherein $V_{th}$ is a threshold bias voltage.

Since two ends of the storage capacitor C are the reference level Vref supplied by the first node $Q_1$ and the data signal DATA supplied by the second node $Q_2$, the potential of the two ends of the storage capacitor C are reset.

Figure 6:
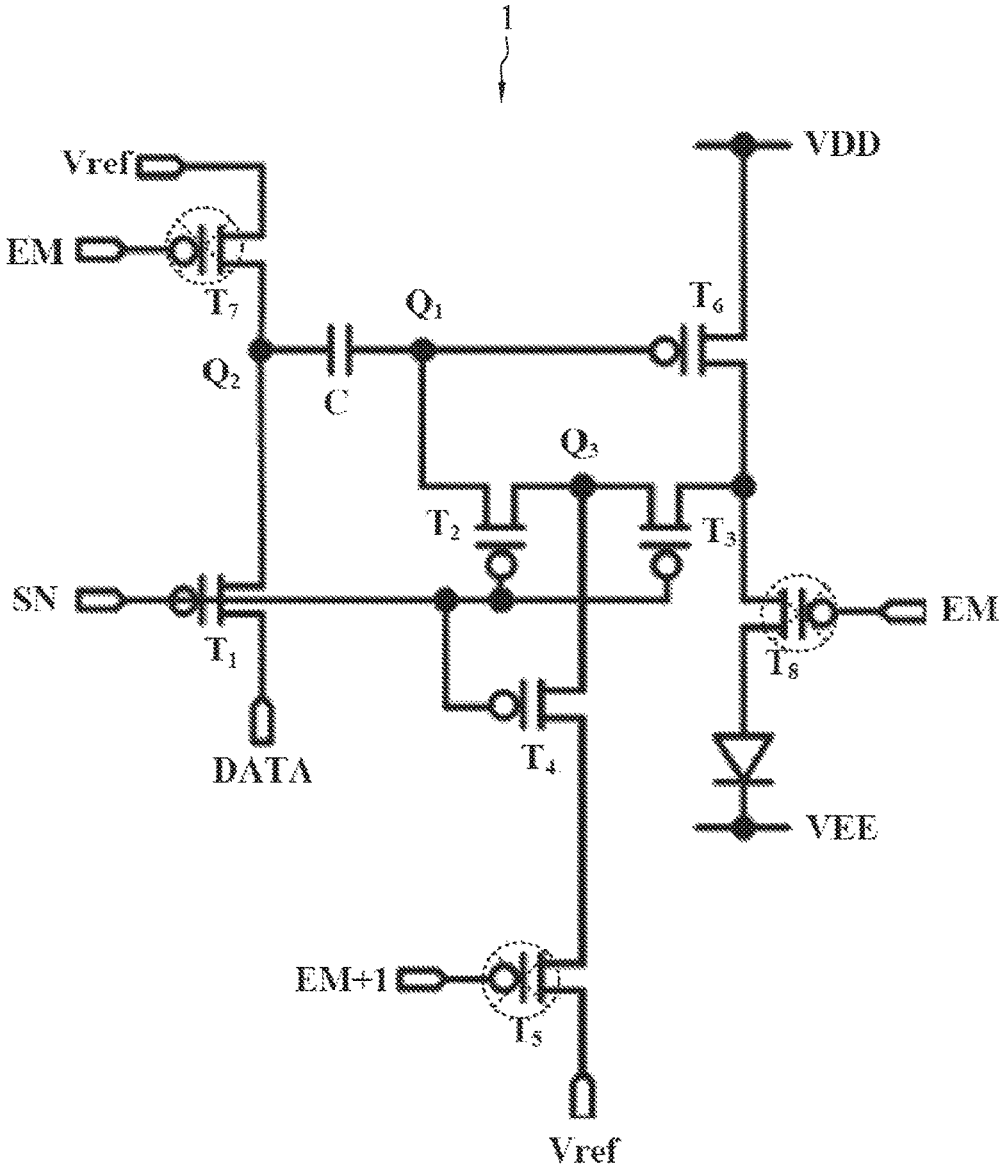
FIG. 6 is a schematic diagram showing an operation of the pixel compensation circuit of FIG. 4 at a second timing.

Please refer to FIG. 4 and FIG. 6. FIG. 6 is a schematic diagram showing an operation of the pixel compensation circuit 1 of FIG. 4 at the second timing $t_2$. In the compensation stage, due to the light emission control signal EM and the sub-light emission control signal EM+1, the fifth transistor $T_5$, the seventh transistor $T_7$ and the eighth transistor $T_8$ are turned off. At this time, the voltage at the first node $Q_1$ is changed from Vref to VDD−|$V_{th}$|, the second node $Q_2$ is kept as the previous status (DARA), and the voltage of the third node $Q_3$ is changed from Vref to VDD−|$V_{th}$|.

At this time, the gate potential $V_g$ of the sixth transistor $T_6$ for driving is VDD−|$V_{th}$|, and the source potential $V_s$ is VDD. The first node $Q_1$ is charged by VDD through the sixth transistor $T_6$ until pinch-off occurs in the sixth transistor $T_6$, thereby making $V_{sg}$=|$V_{th}$|.

Further, since the electrode potentials at two ends of the storage capacitor C are VDD−|$V_{th}$| and DATA, respectively, the potential difference between the two ends of the storage capacitor C is re-balanced.

Figure 7:
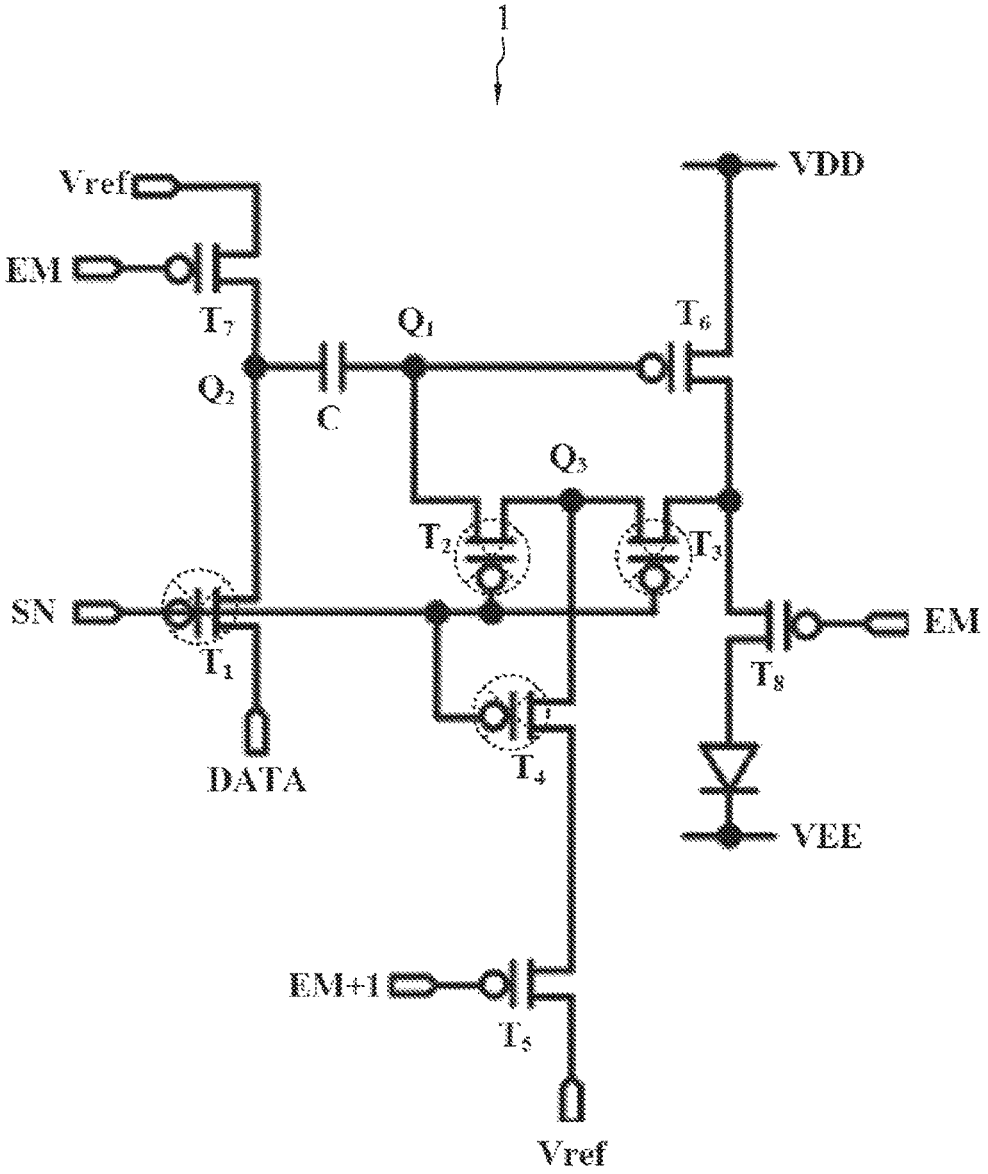
FIG. 7 is a schematic diagram showing an operation of the pixel compensation circuit of FIG. 4 at a third timing.

Please refer to FIG. 4 and FIG. 7. FIG. 7 is a schematic diagram showing an operation of the pixel compensation circuit 1 of FIG. 4 at the third timing $t_3$. In the write light emission stage, due to the scan signal SN, the first transistor $T_1$, the second transistor $T_2$, the third transistor $T_3$ and the fourth transistor $T_4$ are turned off. At this time, the voltage at the first node $Q_1$ is changed from VDD−|$V_{th}$| to VDD−DATA+Vref−|$V_{th}$|, the voltage at the second node $Q_2$ is changed from DATA to Vref, and the third node $Q_3$ is kept as the previous status (VDD−|$V_{th}$|).

At this time, the gate potential of the sixth transistor $T_6$ for driving is VDD−DATA+Vref−|Vth|, and the source potential $V_s$ is VDD. The potential change of the second node $Q_2$ causes that the first node $Q_1$ writes the DATA value due to the coupling effect of the storage capacitor, making $V_{sg}$=DATA−Vref+|$V_{th}$|.

At this time, the operation of this stage would not affected by turn-on or turn-off of the fifth transistor $T_5$.

After compensation, the current for driving the transistor is expressed in the following equation.

$$|I_{sd}|=\kappa*(|V_{sg}|-|V_{th}|)_2=\kappa*(\text{DATA}-V\text{ref})^2$$

There is no Vth and VDD in the above equation, such that the threshold bias voltage $V_{th}$ is compensated and the voltage drop (IR-drop) effect is improved.

Accordingly, the pixel compensation circuit 1 of the present invention can be applied in an active matrix organic light emitting diode display so as to compensate the threshold bias voltage $V_{th}$ of the thin film transistor and avoid image deterioration, such as Mura, resulted from the difference of electrical properties between the components. At the same time, the voltage drop (IR-drop) resulted from the distribution of the system power can be compensated so as to improve brightness of the panel while the display is illuminated.

In comparison with the conventional technologies, the pixel compensation circuit of the present invention can be used for compensating the critical parameter, such as a threshold voltage $V_{th}$, associated with the electrical properties of the components in thin film transistors of an active matrix organic light emitting diode display or similar illumination systems, so as to improve the image quality and avoid uneven brightness resulted from the voltage drop (IR-drop) effect. The pixel compensation circuit of the present invention is defined in a sub-pixel area, wherein there are eight thin film transistors and one capacitor, and the circuit is operated by two control signals. In contrast, three control signals are required in the conventional technologies. The fewer control signals are required in the present invention, which is benefit to the flexibility of the layout and design of specification.

The features and scope of the present invention is clearly described, but not limited by, the illustrations of the above embodiments. Furthermore, the various changes and equivalent arrangements are covered by the scope of claims of the present invention.

What is claimed is:

1. A pixel compensation circuit, comprising:

an input module, receiving a reference level and a data signal and generating a first signal in response to a light emission control signal and a scan signal;

a reset module, receiving the reference level and generating a reset signal in response to a sub-light emission control signal and the scan signal, wherein the sub-light emission control signal and the light emission control signal shift for one line time;

a data processing module, receiving the first signal, the reset signal and a first voltage, and generating a second signal in response to the scan signal; and a switch module, receiving the second signal and generating a light emission signal in response to the light emission control signal, wherein the light emission signal is for driving a light emitting component.

2. The pixel compensation circuit of claim 1, wherein the input module comprises:

a first transistor, having a first source terminal applied with the data signal, a first gate terminal applied with the scan signal, and a first drain terminal connected to a second node;

a seventh transistor, having a seventh source terminal applied with the reference level, a seventh gate terminal applied with the light emission control signal, and a seventh drain terminal connected to the second node; and a storage capacitor, having a first electrode and a second electrode, wherein the first electrode is connected to the second node, and the second electrode is connected to the data processing module.

3. The pixel compensation circuit of claim 1, wherein the data processing module comprises:

a sixth transistor, having a sixth source terminal applied with the first voltage, a sixth gate terminal connected to the input module, and a sixth drain terminal connected to the switch module;

a third transistor, having a third source terminal connected to the sixth drain terminal, a third gate terminal applied with the scan signal, and a third drain terminal connected to a third node; and a second transistor, having a second source terminal connected to the third node, a second gate terminal applied with the scan signal, and a second drain terminal connected to the sixth gate terminal.

4. The pixel compensation circuit of claim 3, wherein the reset module comprises:

a fifth transistor, having a fifth source terminal applied with the reference level, and a fifth gate terminal applied with a sub-light emission control signal; and a fourth transistor, having a fourth source terminal connected to a fifth drain terminal of the fifth transistor, a fourth gate terminal applied with the scan signal, and a fourth drain terminal connected to the third node.

5. The pixel compensation circuit of claim 1, wherein the switch module comprises:

an eighth transistor, having an eighth source terminal connected to the data processing module, an eighth gate terminal applied with the light emission control signal, and an eighth drain terminal for outputting the light emission signal.

6. The pixel compensation circuit of claim 1, wherein when a plurality of the pixel compensation circuits are connected in series to form a set of pixel compensation circuits, the light emission control signal of an (N+1)th level pixel compensation circuit is used as the sub-light emission control signal of an Nth level pixel compensation circuit, and N is a positive integer.

7. An active-matrix organic light emitting diode display, comprises:

a pixel compensation circuit, comprising:

an input module, receiving a reference level and a data signal and generating a first signal in response to a light emission control signal and a scan signal;

a reset module, receiving the reference level and generating a reset signal in response to a sub-light emission control signal and the scan signal, wherein the sub-light emission control signal and the light emission control signal shift for one line time;

a data processing module, receiving the first signal, the reset signal and a first voltage, and generating a second signal in response to the scan signal; and a switch module, receiving the second signal and generating a light emission signal in response to the light emission control signal, wherein the light emission signal is for driving a light emitting component.

8. The active-matrix organic light emitting diode display of claim 7, wherein the input module comprises:

a first transistor, having a first source terminal applied with the data signal, a first gate terminal applied with the scan signal, and a first drain terminal connected to a second node;

a seventh transistor, having a seventh source terminal applied with the reference level, a seventh gate terminal applied with the light emission control signal, and a seventh drain terminal connected to the second node; and a storage capacitor, having a first electrode and a second electrode, wherein the first electrode is connected to the second node, and the second electrode is connected to the data processing module.

9. The active-matrix organic light emitting diode display of claim 7, wherein the data processing module comprises:

a sixth transistor, having a sixth source terminal applied with the first voltage, a sixth gate terminal connected to the input module, and a sixth drain terminal connected to the switch module;

a third transistor, having a third source terminal connected to the sixth drain terminal, a third gate terminal applied with the scan signal, and a third drain terminal connected to a third node; and a second transistor, having a second source terminal connected to the third node, a second gate terminal applied with the scan signal, and a second drain terminal connected to the sixth gate terminal.

10. The active-matrix organic light emitting diode display of claim 9, wherein the reset module comprises:

a fifth transistor, having a fifth source terminal applied with the reference level, and a fifth gate terminal applied with a sub-light emission control signal; and a fourth transistor, having a fourth source terminal connected to a fifth drain terminal of the fifth transistor, a fourth gate terminal applied with the scan signal, and a fourth drain terminal connected to the third node.

11. The active-matrix organic light emitting diode display of claim 7, wherein the switch module comprises:

an eighth transistor, having an eighth source terminal connected to the data processing module, an eighth gate terminal applied with the light emission control signal, and an eighth drain terminal for outputting the light emission signal.

12. The active-matrix organic light emitting diode display of claim 7, wherein when a plurality of the pixel compensation circuits are connected in series to form a set of pixel compensation circuits, the light emission control signal of an (N+1)th level pixel compensation circuit is used as the sub-light emission control signal of an Nth level pixel compensation circuit, and N is a positive integer.

13. The active-matrix organic light emitting diode display of claim 7, wherein the light emitting component has a first pole and a second pole, the first pole is used for receiving the light emission signal, and the second pole is connected to a second voltage having a level different from that of the first voltage.

14. A display system, comprising:

a pixel compensation circuit, comprising:

an input module, receiving a reference level and a data signal and generating a first signal in response to a light emission control signal and a scan signal;

a reset module, receiving the reference level and generating a reset signal in response to a sub-light emission control signal and the scan signal, wherein the sub-light emission control signal and the light emission control signal shift for one line time;

a data processing module, receiving the first signal, the reset signal and a first voltage, and generating a second signal in response to the scan signal; and a switch module, receiving the second signal and generating a light emission signal in response to the light emission control signal, wherein the light emission signal is for driving a light emitting component.

15. The display system of claim 14, wherein the input module comprises:

a first transistor, having a first source terminal applied with the data signal, a first gate terminal applied with the scan signal, and a first drain terminal connected to a second node;

a seventh transistor, having a seventh source terminal applied with the reference level, a seventh gate terminal applied with the light emission control signal, and a seventh drain terminal connected to the second node; and a storage capacitor, having a first electrode and a second electrode, wherein the first electrode is connected to the second node, and the second electrode is connected to the data processing module.

16. The display system of claim 14, wherein the data processing module comprises:

a sixth transistor, having a sixth source terminal applied with the first voltage, a sixth gate terminal connected to the input module, and a sixth drain terminal connected to the switch module;

a third transistor, having a third source terminal connected to the sixth drain terminal, a third gate terminal applied with the scan signal, and a third drain terminal connected to a third node; and a second transistor, having a second source terminal connected to the third node, a second gate terminal applied with the scan signal, and a second drain terminal connected to the sixth gate terminal.

17. The display system of claim 16, wherein the reset module comprises:

a fifth transistor, having a fifth source terminal applied with the reference level, and a fifth gate terminal applied with a sub-light emission control signal; and a fourth transistor, having a fourth source terminal connected to a fifth drain terminal of the fifth transistor, a fourth gate terminal applied with the scan signal, and a fourth drain terminal connected to the third node.

18. The display system of claim 14, wherein the switch module comprises:

an eighth transistor, having an eighth source terminal connected to the data processing module, an eighth gate terminal applied with the light emission control signal, and an eighth drain terminal for outputting the light emission signal.

19. The display system of claim 14, wherein when a plurality of the pixel compensation circuits are connected in series to form a set of pixel compensation circuits, the light emission control signal of an (N+1)th level pixel compensation circuit is used as the sub-light emission control signal of an Nth level pixel compensation circuit, and N is a positive integer.

20. The display system of claim 14, further comprising a display pixel circuit area composed of a plurality of the pixel compensation circuits connected in series and in parallel.

* * * * *